US005380400A

United States Patent [19]

Abys et al.

[11] Patent Number: 5,380,400

[45] Date of Patent: Jan. 10, 1995

[54] CHEMICAL ETCHANT FOR PALLADIUM

[75] Inventors: Joseph A. Abys, Warren; Joseph J. Maisano, Jr., Denville; Heinrich K. Straschil, Summit, all of N.J.

[73] Assignee: AT&T Corp., Murray Hill, N.J.

[21] Appl. No.: 175,091

[22] Filed: Dec. 29, 1993

[51] Int. Cl.[6] ..... B44C 1/22; C23F 1/00; C09K 13/02

[52] U.S. Cl. ..... 156/656; 156/637; 156/664; 252/79.5

[58] Field of Search ..... 156/637, 639, 656, 664; 252/79.5, 156; 134/2, 29, 34; 423/22

[56] References Cited

U.S. PATENT DOCUMENTS

| | | | |
|---|---|---|---|
| 2,185,858 | 1/1940 | Mason | 204/1 |
| 2,649,361 | 8/1953 | Springer et al. | 41/42 |
| 3,102,808 | 9/1963 | Weisberg et al. | 75/97 |
| 3,242,090 | 3/1966 | Grunwald | 252/79.1 |
| 3,437,431 | 4/1969 | Platz et al. | 23/50 |
| 3,655,363 | 4/1972 | Tsutsumi | 75/101 |
| 3,819,494 | 6/1974 | Fountain | 204/146 |
| 3,839,110 | 10/1974 | Shankoff | 156/8 |
| 3,935,005 | 1/1976 | Solidum et al. | 75/105 |
| 4,483,739 | 11/1984 | Too et al. | 156/656 |
| 4,548,791 | 10/1985 | Fletcher et al. | 423/22 |

FOREIGN PATENT DOCUMENTS 285833 9/1968 Australia .

*Primary Examiner*—William Powell
*Attorney, Agent, or Firm*—Oleg E. Alber

[57] ABSTRACT

A cyanide based aqueous solution for stripping palladium from copper-containing substrate. The solution includes a cyanide radical source compound, $Na_2CO_3$, a nitrobenzoic acid, NaOH, thallium compound, an organo mercapto compound, and water. The presence of the organo mercapto compound in thallium containing cyanide bath permits efficient stripping of palladium from copper containing substrates with minimum corrosion damage to the substrate.

37 Claims, 1 Drawing Sheet

CHEMICAL ETCHANT FOR PALLADIUM

FIELD OF THE INVENTION

The invention concerns a process for fabrication of devices, in which palladium-containing thin films are either patterned or removed by a chemical etching procedure.

BACKGROUND OF THE INVENTION

In the fabrication of many electronic devices, palladium (and its alloys) is often used as a substitute for gold, e.g., as a layer plated on top of copper or nickel, and may be provided with a flash of gold, such as hard gold. It is used as a surface for plating gold, copper, nickel and various other metals thereon or to preclude diffusion of one metal into another metal, for example nickel into gold. Due to the cost of precious metals it has become extremely important that means be provided for stripping them from the underlaying metals completely and with minimum contamination and corrosion, both to remove imperfectly formed deposits and to permit recovery of the metal from discarded or worn-out parts.

Numerous means for effecting the removal of precious metals from substrates may be found in the prior art. Unfortunately, while the prior art processes are effective in removing gold, the prior art processes are quite ineffective for palladium.

As an exception to this generalization Augustus Fletcher et al. disclose in U.S. Pat. No. 4,548,791 a thallium-containing composition for effectively stripping palladium. The solution contains a thallium compound in addition to a nitrobenzoate derivative, a soluble cyanide and certain optional ingredients, including lead compounds. However, while this solution effectively removes gold and palladium, it actively attacks copper and copper-containing substrates, rendering this solution unsuitable for use in those instances when palladium forms one of the films or layers of a composite including copper or is on a copper-containing substrate. An example of the latter would be a palladium film on a copper-based lead frame or on copper based connections, etc.

Thus, the need remains for a composition which is capable of stripping deposits comprising palladium and other precious metals, such as gold flash-coated palladium layers, without an undue damage to an underlaying metal, such as copper.

SUMMARY OF THE INVENTION

A cyanide based aqueous solution for stripping palladium from copper-containing substrate. The solution includes a cyanide radical source compound, $Na_2CO_3$, a nitrobenzoic acid, NaOH, thallium compound, an organo mercapto compound, and water. The presence of the organo mercapto compound in thallium containing cyanide bath permits efficient stripping of palladium from copper containing substrates with minimum corrosion damage to the substrate.

DETAILED DESCRIPTION

Figure 1:
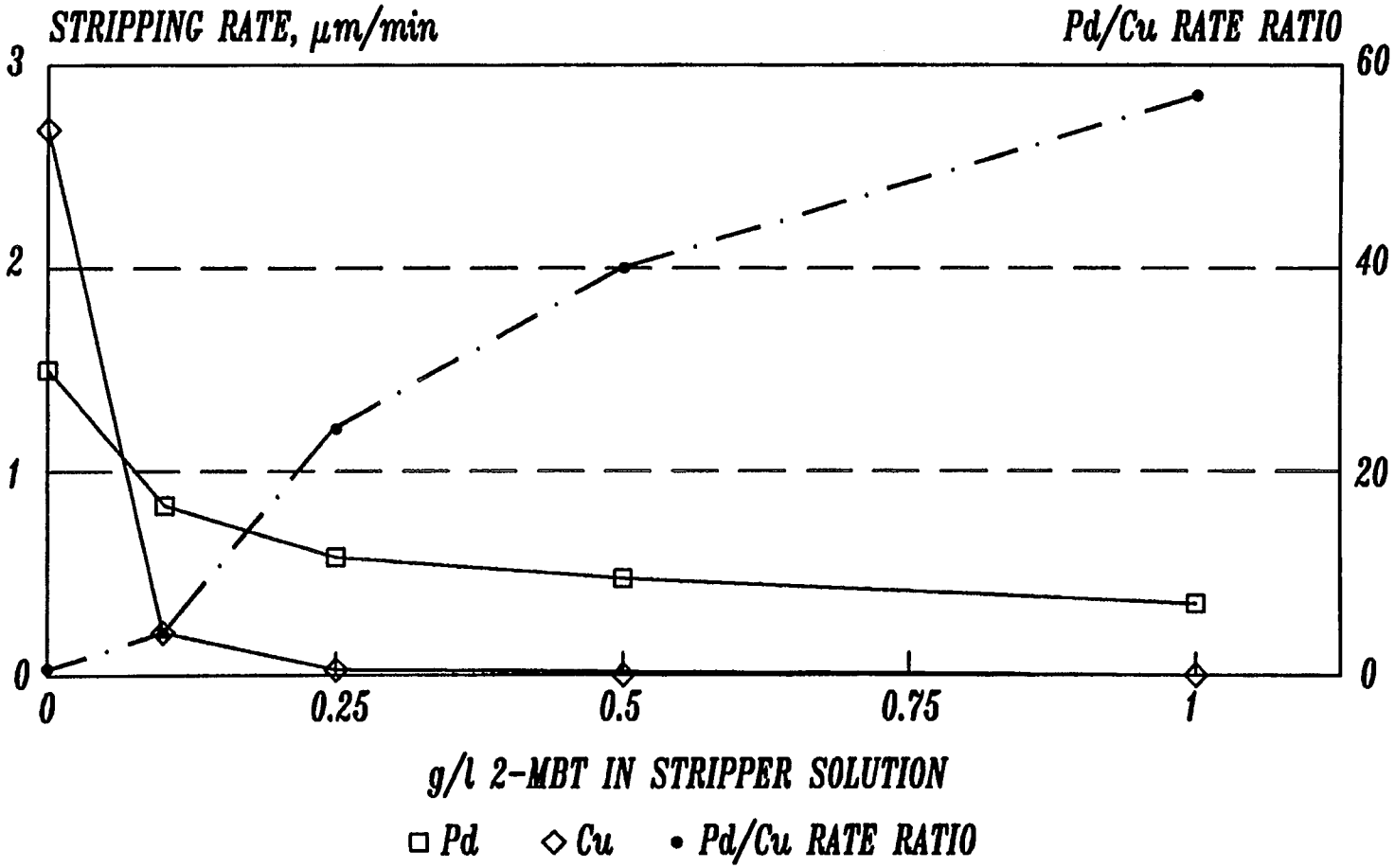
FIG. 1 is a chart of plots representing the effect of varied amounts in grams per liter (g/l) of 2-mercaptobenzothiazole on the etching rate of Pd and Cu and a plot of Pd/Cu etching rate ratio.

The etching solution embodying the invention is a three-part composition including an oxidant, an inhibitor and a salt mixture. The three pans are prepared separately and are mixed shortly before the use.

The oxidant is prepared as Concentrate I by combining 15–40 gram per liter (g/l) sodium hydroxide (NaOH), 60–120 g/l 3-nitrobenzoic acid ($O_2N.C_6H_4.CO_2H$), 0.3–0.6 g/l thallous nitrate ($TlNO_3$) and sufficient water to prepare one liter of Concentrate I.

The inhibitor is prepared as Concentrate II by dissolving 10–40 g of 2-mercaptobenzothiazole in a mixture of methylethyl ketone (MEK) and isopropanol (IPA) mixed in a ratio of 7:3 and in an amount sufficient to prepare 1 liter of Concentrate II.

The salt mixture is prepared by mixing potassium cyanide (KCN), sodium carbonate ($Na_2CO_3$) and water so as to prepare one liter of salt mixture solution containing 50–200 g/l of KCN and 25–100 g/l $Na_2CO_3$. Instead of KCN, 40–160 g/l sodium cyanide (NaCN) may be used in the salt mixture.

The stripping solution is prepared by adding in small portions Concentrate I and Concentrate II, in succession, to the salt mixture solution, mixing thoroughly after each addition and then adding D.I. water in an amount sufficient to provide one liter of solution containing 50–200 g/l KCN or 40–160 g/l NaCN
25–100 edl $Na_2CO_3$
100–400 ml/l Concentrate I, and
4–20 ml/l Concentrate II The so produced stripping solution shall comprise the following ingredients:

50–200 g/l KCN or 40–160 g/l NaCN
25–100 g/l $Na_2CO_3$
10–50 g/l 3-nitrobenzoic acid
4–10 g/l NaOH
0.075–0.15 g/l $TlNO_3$
0.1–0.5 g/l 2-mercaptobenzothiazole The pH of the stripping solution may range from 10 to 14, preferably from 10.5 to 12.5.

In preparing the three parts of the stripping solution, other compounds may be used instead of or in combination with a preferred compound being used. For example, instead of or in addition to the 3-nitrobenzoic acid, acids and their derivatives selected from 2-nitrobenzoic acid, 4-nitrobenzoic acid, 2-nitrobezenesulfonic acid, 3-nitrobenzenesulfonic acid, 4-nitrobenzenesulfonic acid, chloronitrobenzoic acid isomers, chloronitrobenzenesulfonic acid isomers, and mixtures of the above acids and their derivatives, may be used as such or in the form of their alkali salts. The thallium salts may be selected from the group consisting of thallous ($Tl^{+}$) or thallic ($Tl^{3+}$) salts of nitric, sulfuric, phosphoric, and acetic acids, and other soluble thallium salts. The inhibitor may be prepared using, instead of or in addition to 2-mercaptobenzothiazole, the following compounds: 2-mercaptobenzoxazole, 2-benzimidazolethiol, 2-mercapto-5-methylbenzimidazole and their derivatives. These inhibitors have been mentioned by E. H. Too et al. in U.S. Pat. No. 4,483,739 issued Nov. 20, 1984 as a corrosion inhibitor in gold stripping solutions. However, only the 2-mercaptobenzothiazole exhibited the synergistic effect in a thallium containing solution.

An exemplary stripping solution is prepared as described in Examples 1–4 below.

EXAMPLE 1

To prepare 1 liter of Concentrate I dissolve 30 g of solid sodium hydroxide (NaOH) in 850 ml of D.I. water, dissolve 120 g solid 3-nitrobenzoic acid ($O_2N.C_6H_4.CO_2H$) adding it in portions to the NaOH solution, prepare an aqueous solution containing 25 g/l of Tl by dissolving 32.6 g of thallous nitrate ($TlNO_3$) per liter and add 16 ml of this solution to the NaOH and nitrobenzoic acid solution, add sufficient D.I. water to make one liter of solution, and mix thoroughly.

EXAMPLE 2

To prepare 1 liter of Concentrate II prepare a mixed solvent by combining 7 volume units of methylethyl ketone (MEK) and 3 volume units of isopropanol (IPA), dissolve 30 g 2-mercaptobenzothiazole in 950 ml of the mixed solvent, and, after filtering the solution, fill the filtrate with the mixed solvent to make one liter of Concentrate II.

EXAMPLE 3

To prepare one liter of salt mixture solution dissolve 167 g KCN and 83 g $Na_2CO_3$ in one liter of D.I. water.

EXAMPLE 4

To prepare one liter of the exemplary stripping solution add 250 ml of Concentrate I of Example 1 in small portions to 600 ml of salt mixture solution of Example 3, add 10 ml of Concentrate II of Example 2, mix thoroughly, and fill with sufficient D.I. water to make one liter of stripping solution. The resultant exemplary stripping solution will have the following composition:

100 g/l potassium cyanide (KCN),
50 g/l sodium carbonate ($Na_2CO_3$),
30 g/l 3-nitrobenzoic acid ($O_2N.C_6H_4.CO_2H$),
7.5 g/l sodium hydroxide NaOH,
0.1 g/l thallium as thallous nitrate (0.13 g/l $TlNO_3$), and
0.3 g/l 2-mercaptobenzothiazole ($C_7H_5NS_2$).

The salt mixture solution and Concentrates I and II are preferably combined and heated to a temperature within a range of from 40° to 45° C. shortly before use. The stripping is conducted at this temperature with moderate to high agitation.

Experiments were conducted by immersing a Cu foil Pd-plated on both sides and an unplated Cu foil in separate vessels containing the same solution in each experiment. The solution was kept at a temperature ranging from 40° to 45° C. and with moderate to high agitation. The experiments show that presence of both thallium and 2-mercaptobenzothiazole in a cyanide etching solution (Examples 5, 8, 11 and 13) leads to an increase in the etching rate of Pd and decrease in the etching rate of Cu relative to experiments in which the etching solution contained neither thallium nor 2-mercaptobenzothiazole (Examples 6 and 9) or contained only thallium (Example 10) or only 2-mercaptobenzothiazole (Examples 7 and 12).

The experiments show that while addition of thallium (Example 10) to a cyanide etching solution (Examples 6 and 9) leads to an increase in the rate of removal of Pd while the rate of Cu etching remains high, addition of 2-mercaptobenzothiazole (Examples 7 and 12) to the cyanide etching solution reduces the etching rate of Pd but has hardly any effect on the etching rate of Cu in the same solution. It is only when both the thallium and the 2-mercaptobenzothiazole were included in the cyanide-etching solution, that an unexpected, synergistic effect took place, namely, removal of Pd was increased while removal of Cu decreased drastically. Copper corrosion is inhibited only when both additives are present, that is 2-mercaptobenzothiazole is so effective only in the presence of thallium in the solution. This is in spite of the fact that $Tl^+$ ion forms a precipitate with 2-mercaptobenzothiazole, whereby the concentrations of both species in the aqueous solution are diminished.

Below are the experiments that show the effect of thallium ion and 2-mercaptobenzothiazole on stripping Pd from Cu substrate and on Cu corrosion.

EXAMPLE 5

A Pd stripping solution of Example 4, that is one containing both Tl and 2-mercaptobenzothiazole, was used to remove Pd from a Cu substrate. A Cu foil electroplated with Pd on both sides was immersed in this solution at 42° C. with moderate agitation for one minute. During this interval 1.0 micrometer per minute (μm/min) of Pd thickness was removed from the surface. An unplated Cu foil immersed in this solution under the same conditions lost 0.32 μm/min.

EXAMPLE 6

A Pd stripping solution similar to that of Example 4, but containing neither Tl nor 2-mercaptobenzothiazole, was used to compare the etching rate of this solution with that of Example 5. When immersed in the solution under the same conditions, Pd was stripped from the Pal-plated Cu-foil at a rate of 0.37 μm/min and Cu from the unplated Cu foil at a rate of 4.3 μm/min conditions.

EXAMPLE 7

After the addition of 1 g/l of 2-mercaptobenzothiazole to the stripping solution of Example 6, the Pd stripping rate was reduced to 0.08 μm/min, but the Cu stripping rate was at 4.4 μm/min.

EXAMPLE 8

After the addition of 300 ppm thallium to the stripping solution of Example 7 which already contained 1 g/l of 2-mercaptobenzothiazole, the Pd stripping rate was increased to 1.0 μm/min; however a copper foil immersed under the same conditions lost only 0.32 μm/min in thickness. Due to the large concentration of 2mercaptobenzothiazole, relative to the recommended 0.1–0.5 g/l range, much of the added thallium was precipitated, and the potential effect of thallium addition was not fully realized.

EXAMPLE 9

A Pd stripping solution containing 100 g/l potassium cyanide (KCN), 50 g/l sodium carbonate ($Na_2CO_3$), 7.5 g/l sodium hydroxide (NaOH), and 30 g/l 4-nitrobenzoic acid ($O_2N.C_6H_4.CO_2H$), was prepared without either thallium or 2-mercaptobenzothiazole. A copper foil electroplated with palladium on both sides and an unplated Cu foil were immersed in separate vessels in this solution at 42° C. with moderate agitation, for one minute. During this interval, 0.30 μm (average) of palladium thickness were dissolved from the surface. A copper foil immersed under the same conditions lost 5.1 μm (average) thickness of copper metal.

EXAMPLE 10

100 ppm thallium (as $TlNO_3$) were added to the solution of Example 9. A palladium-plated copper foil was immersed under the same conditions as in Example 9. This time, 0.97 μm (average) of palladium were stripped. An unplated copper foil immersed under the same conditions lost 5.3 μm (average) of thickness. It can be seen that through the addition of thallium the attack on palladium was accelerated, while the rate of attack on copper remained high.

EXAMPLE 11

300 ppm 2-mercaptobenzothiazole were added to the solution of Example 10, which already contained 100 ppm thallium. A small amount of precipitate formed, which was not removed. A palladium-plated copper foil, immersed under the same conditions as in Example 9, lost 0.88 μm/min (average) of Pd thickness; but in contrast to Examples 9 and 10, an unplated copper foil lost only 0.18 μm/min (average) under the same conditions.

EXAMPLE 12

300 ppm 2-mercaptobenzothiazole were added to a fresh solution according to Example 9. The attack rate on palladium on a palladium plated copper foil immersed under the same conditions as in Example 9 was reduced to 0.18 μm/min (average); the attack rate on copper remained high, being only reduced to 4.8 μm/min (average). This shows that in the absence of thallium the addition of 2-mercaptobenzothiazole to a conventional stripping solution does not significantly inhibit the rate of copper corrosion.

EXAMPLE 13

100 ppm thallium were added to the solution of Example 12. A small amount of precipitate formed which was not removed. Under the same conditions as in Example 9, 0.77 μm/min (average) of palladium were stripped from a palladium plated copper foil, but only 0.047 μm/min (average) were lost from an unplated copper foil. This result and the results of Examples 5, 8 and 11 prove the synergistic inhibiting effect on copper corrosion of the proposed combination of thallium and 2-mercaptobenzothiazole in this type of stripping solution.

Another experiment shows the influence of 2-mercaptobenzothiazole added in increments to a thallium-containing stripping solution.

EXAMPLE 14

Incremental amounts of 2-mercaptobenzothiazole (2-MBT) were added to a stripping solution containing 100 g/l potassium cyanide (KCN), 50 g/l sodium carbonate ($Na_2CO_3$), 7.5 g/l sodium hydroxide (NaOH), 30 g/l 3-nitrobenzoic acid ($O_2N.C_6H_4.CO_2H$) and 100 ppm of thallium. The following stripping rates were observed on a Pd-plated Cu foil and on an unplated Cu foil when immersed in the stripping solution at 45° C. with moderate agitation:

| 2-MBT Content, g/l | Pd Stripping Rate, μm/min | Cu Stripping Rate, μm/min |
|---|---|---|
| 0.0 | 1.51 | 2.67 |
| 0.1 | 0.82 | 0.21 |
| 0.25 | 0.58 | 0.024 |
| 0.5 | 0.48 | 0.012 |
| 1.0 | 0.34 | 0.006 |

These data show that the copper corrosion is much more inhibited than the palladium corrosion by increasing addition of 2-mercaptobenzothiazole. The plot shown in FIG. 1 of the drawing, presents the above data as curve 1 (□) representing the Pd stripping rate and curve 2 (◆) representing the Cu stripping rate, both in μm/min. Curve 3 (●) represents a derived ratio of Pd stripping rate versus Cu stripping rate The high level of copper passivation obtained with 2-mercaptobenzothiazole in the Tl-containing stripper solution is surprising. Other additives typically in commercial use for the protection of copper in nickel-stripping were found virtually ineffective in this palladium stripping solution. For example, benzotriazole slowed down the corrosion rate of copper to only one half (1.8 μm/min vs 3.8 μm/min without inhibitor); thiourea did not inhibit the corrosion of copper at all and accelerated the attack on nickel by a factor of 10. By contrast, 2-mercaptobenzothiazole decreased the rate of attack on copper by a factor of 50–250.

Additional advantages and modifications will readily occur to those skilled in the art. Therefore, the invention in its broader aspects is not limited to the specific details, representative devices, and illustrated examples shown and described. Accordingly, various modifications may be made without departing from the spirit or scope of the general inventive concept as defined by the appended claims and their equivalents.

We claim:

1. A method for stripping palladium and its alloys from copper-containing substrates, which comprises preparing a palladium stripping solution and immersing pans to be stripped of Pd into said solution, in which said stripping solution is prepared by preparing an oxidant solution comprising a hydroxide, nitrobenzoic acid and thallium compound in water, preparing a Cu-corrosion inhibitor solution comprising an organo mercapto compound in solvent therefore, preparing a salt solution comprising cyanide radical source compound and $Na_2CO_3$ in water, and mixing the three solutions by adding oxidant solution in increments and then the inhibitor solution to the salt solution under mixing.

2. The method of claim 1, in which the so prepared stripping solution comprises 50–200 g/l KCN or 40–100 g/l NaCN, 25–100 g/l $Na_2CO_3$, 10–50 g/l 2-,3- or 4-nitrobenzoic acid 4–10 g/l NaOH, 0.075–0.15 g/l $TlNO_3$, 0.1–0.5 g/l 2-mercaptobenzothiazole.

3. The method of claim 1, in which a) said oxidant solution is prepared by dissolving 30 g of solid sodium hydroxide in 850 ml of D.I. water, dissolving 120 g of solid nitrobenzoic acid, selected from 2-,3- and 4-nitrobenzoic acids, while adding it in portions to the sodium hydroxide solution, preparing an aqueous solution containing 25 g/l of Tl by dissolving 32.6 g of thallous nitrate ($TlNO_3$) per liter and adding 16 ml of this solution to the NaOH and nitrobenzoic acid solution, and adding sufficient D.I. water to make one liter of oxidant solution;

b) said inhibitor solution is prepared by combining 7 volume units of methylethyl ketone and 3 volume units of isopropanol, dissolving 30 g of 2-mercaptobenzothiazole in 950 ml of the mixed solvent, and after filtering this solution, filling the filtrate with the mixed solvent to make one liter of the inhibitor solution;

c) said salt solution is prepared by dissolving 167 g KCN and 83 g $Na_2CO_3$ in one liter of water; and d) preparing one liter of stripping solution by adding 250 ml of the oxidant solution in increments to 600 ml of the salt solution, adding 10 ml of the inhibitor solution, mixing the combination thoroughly, and filling with sufficient D.I. water to make one liter of the stripping solution.

4. The method of claim 3, in which the so-prepared stripping solution comprises 100 g/l potassium cyanide (KCN), 50 g/l sodium carbonate ($Na_2CO_3$), 30 g/l 2,3 or 4-nitrobenzoic acid ($O_2N.C_6H_4.CO_2H$), 7.5 g/l sodium hydroxide NaOH, 0.1 g/l thallium as thallous nitrate (0.13 g/l $TlNO_3$)

0.3 g/l 2-mercaptobenzothiazole ($C_7H_5NS_2$), and sufficient D.I. water to make up one liter of solution.

5. The method of claim 1, in which the prepared stripping solution is heated to a temperature ranging from 40° to 45° C., and said stripping is being conducted under moderate agitation.

6. The method of claim 1, in which said oxidant solution, said inhibitor solution and said salt mixture solution are combined only prior to the use of the stripping solution.

7. The method of claim 1, in which said oxidant solution is added in increments to said salt mixture solution, followed by the addition of the inhibitor solution and addition of D.I. water, and mixing of the components.

8. The method of claim 1, in which said organo mercapto compound is selected from the group consisting of 2-mercaptobenzothiazole, 2-mercaptobenzoxazole, 2-benzimidazolethiol, 2-mercapto-5 methylbenzimidazole, their derivatives and their mixtures.

9. The method of claim 1, in which said organo mercapto compound comprises 2-mercaptobenzothiazole.

10. The method of claim 1, in which said cyanide radical compound comprises at least one of KCN and NaCN.

11. The method of claim 1, in which said nitrobenzoic acid derivative is selected from the group consisting of 2-nitrobenzoic acid, 3-nitrobenzoic acid, 4-nitrobenzoic acid, 2-nitrobenzenesulfonic acid, 3-nitrobenzenesulfonic acid, 4-nitrobenzenesulfonic acid, chloronitrobenzoic acid isomers, chloronitrobenzenesulfonic acid isomers, and mixtures of these acids and their derivatives.

12. The method of claim 1, in which said nitrobenzoic acid derivative comprises at least one of 2-nitrobenzoic acid, 3-nitrobenzoic acid and 4-nitrobenzoic acid.

13. The method of claim 1, in which said thallium compound is selected from the group consisting of thallous ($Tl^{+}$) and thallic ($Tl^{3+}$) salts of nitric, sulfuric, phosphoric and acetic acids, and other soluble thallium salts.

14. The method of claim 11, in which said thallium compound comprises a nitrate.

15. A method of preparing an aqueous stripping solution for stripping palladium from copper-containing substrates, which comprises preparing an oxidant solution comprising a hydroxide, a nitrobenzoic acid thallium compound in water, preparing a Cu-corrosion inhibitor solution comprising an organo mercapto compound in solvent therefore, preparing a salt solution comprising cyanide radical source compound and $Na_2CO_3$ in water, and mixing the three solutions by adding oxidant solution in small portions and then the inhibitor solution to the salt solution under mixing.

16. The method of claim 15, in which the so prepared stripping solution comprises 50–200 g/l KCN or 40–100 g/l NaCN, 25–100 g/l $Na_2CO_3$, 10–50 g/l 2-, 3- or 4-nitrobenzoic acid, 4–10 g/l NaOH, 0.075–0.15 g/l $TlNO_3$, and 0.1–0.5 g/l 2-mercaptobenzothiazole.

17. The method of claim 15, in which a) said oxidant solution is prepared by dissolving 30 g of solid sodium hydroxide in 850 ml of D.I. water, dissolving 120 g of solid nitrobenzoic acid, selected from 2-, 3- and 4-nitrobenzoic acids, while adding it in portions to the sodium hydroxide solution, preparing an aqueous solution containing 25 g/l of Tl by dissolving 32.6 g of thallous nitrate ($TlNO_3$) per liter and adding 16 ml of this solution to the NaOH and nitrobenzoic acid solution, and adding sufficient D.I. water to make one liter of oxidant solution;

b) said inhibitor solution is prepared by combining 7 volume units of methylethyl ketone and 3 volume units of isopropanol, dissolving 30 g of 2-mercaptobenzothiazole in 950 ml of the mixed solvent, and after filtering this solution, filling the filtrate with the mixed solvent to make one liter of the inhibitor solution;

c) said salt solution is prepared by dissolving 167 g KCN and 83 g $Na_2CO_3$ in one liter of water and d) one liter of stripping solution is prepared by adding 250 ml of the oxidant solution in small portions to 600 ml of the salt solution, adding 10 ml of he inhibitor solution, mixing the combination thoroughly, and filling sufficient D.I. water to make one liter of the stripping solution.

18. The method of claim 15, in which said thallium compound comprises a nitrate.

19. The method of claim 15, in which said oxidant solution, said inhibitor solution and said salt mixture solution are combined only prior to the use of the stripping solution.

20. The method of claim 15, in which said oxidant solution is added in increments to said salt mixture solution, followed by the addition of the inhibitor solution and addition of D.I. water, and mixing of the components.

21. The method of claim 15, in which said organo mercapto compound is selected from the group consisting of 2-mercaptobenzothiazole, 2-mercaptobenzoxazole, 2-benzimidazolethiol, 2-mercapto-5 methylbenzimidazole, their derivatives and their mixtures.

22. The method of claim 15, in which said organo mercapto compound comprises 2-mercaptobenzothiazole.

23. The method of claim 15, in which said cyanide radical compound comprises at least one of KCN and NaCN.

24. The method of claim 15, in which said nitrobenzoic acid derivative is selected from the group consisting of 2-nitrobenzoic acid, 3-nitrobenzoic acid, 4-nitrobenzoic acid, 2-nitrobenzenesulfonic acid, 3-nitrobenzenesulfonic acid, 4-nitrobenzenesulfonic acid, chloronitrobenzoic acid isomers, chloronitrobenzenesulfonic acid isomers, and mixtures of these acids and their derivatives.

25. The method of claim 15, in which said nitrobenzoic acid derivative comprises at least one of 2-nitrobenzoic acid, 3-nitrobenzoic acid and 4-nitrobenzoic acid.

26. The method of claim 15, in which said thallium compound is selected from the group consisting of thallous ($Tl^{+}$) and thallic ($Tl^{3+}$) salts of nitric, sulfuric, phosphoric and acetic acids, and other soluble thallium salts.

27. The method of claim 15, in which said thallium compound comprises a nitrate.

28. A solution for stripping palladium and its alloys from copper-containing substrates, which is comprised of from 50 to 200 parts of a cyanide radical source compound, 25–100 parts of $Na_2CO_3$, from 10 to 50 parts of a nitrobenzoic acid, from 4–10 parts of NaOH, from 0.075 to 0.15 parts of a thallium compound, from 0.1 to 0.5 parts of an organo mercapto compound, and water to make up one liter of solution said parts being expressed on a gram per liter (g/l) basis.

29. A stripping solution of claim 28, which comprises
50–200 g/l KCN or 40–100 g/l NaCN,
25–100 g/l $Na_2CO_3$,
10–50 g/l 2-, 3- or 4-nitrobenzoic acid,
4–10 g/l NaOH,
0.075–0.15 g/l $TlNO_3$, and
0.1–0.5 g/l 2-mercaptobenzothiazole.

30. A stripping solution of claim 28, which comprises
100 g/l potassium cyanide (KCN),
50 g/l sodium carbonate ($Na_2CO_3$),
30 g/l2,3 or 4-nitrobenzoic acid ($O_2N.C_6H_4.CO_2H$),
7.5 g/l sodium hydroxide NaOH,
0.1 g/l thallium as thallous nitrate (0.13 g/l $TlNO_3$)
0.3 g/l 2-mercaptobenzothiazole ($C_7H_5NS_2$), and sufficient D.I. water to make up one liter of solution.

31. A stripping solution of claim 28, in which said organo mercapto compound is selected from the group consisting of 2-mercaptobenzothiazole, 2-mercaptobenzoxazole, 2-benzimidazolethiol, 2-mercapto-5 methylbenzimidazole, their derivatives and their mixtures.

32. A stripping solution of claim 28, in which said organo mercapto compound comprises 2-mercaptobenzothiazole.

33. A stripping solution of claim 28, in which said cyanide radical compound comprises at least one of KCN and NaCN.

34. A stripping solution of claim 28, in which said nitrobenzoic acid derivative is selected from the group consisting of 2-nitrobenzoic acid, 3-nitrobenzoic acid, 4-nitrobenzoic acid, 2-nitrobenzenesulfonic acid, 3-nitrobenzenesulfonic acid, 4-nitrobenzenesulfonic acid, chloronitrobenzoic acid isomers, chloronitrobenzenesulfonic acid isomers, and mixtures of these acids and their derivatives.

35. A stripping solution of claim 28, in which said nitrobenzoic acid derivative comprises at least one of 2-nitrobenzoic acid, 3-nitrobenzoic acid and 4-nitrobenzoic acid.

36. A stripping solution of claim 28, in which said thallium compound is selected from the group consisting of thallous ($Tl^{+}$) and thallic ($Tl^{3+}$) salts of nitric, sulfuric, phosphoric and acetic acids, and other soluble thallium salts.

37. A stripping solution of claim 28, in which said thallium compound comprises a nitrate.

* * * * *